US010334370B2

(12) United States Patent
Herscher et al.

(10) Patent No.: US 10,334,370 B2
(45) Date of Patent: Jun. 25, 2019

(54) APPARATUS, SYSTEM AND METHOD FOR REDUCING ACOUSTIC FEEDBACK INTERFERENCE SIGNALS

(71) Applicants: Bret Herscher, Cupertino, CA (US); Takahiro Unno, Foster City, CA (US); Daniel Shen, Stanford, CA (US); Florent Michel, Annemasse (FR); Raphael Michel, Palo Alto, CA (US)

(72) Inventors: Bret Herscher, Cupertino, CA (US); Takahiro Unno, Foster City, CA (US); Daniel Shen, Stanford, CA (US); Florent Michel, Annemasse (FR); Raphael Michel, Palo Alto, CA (US)

(73) Assignee: Eargo, Inc., San Jose, CA (US)

( * ) Notice: Subject to any disclaimer, the term of this patent is extended or adjusted under 35 U.S.C. 154(b) by 0 days.

(21) Appl. No.: 15/373,389

(22) Filed: Dec. 8, 2016

(65) Prior Publication Data

US 2017/0164121 A1 Jun. 8, 2017

Related U.S. Application Data

(60) Provisional application No. 62/264,583, filed on Dec. 8, 2015.

(51) Int. Cl.
*H04R 25/00* (2006.01)

(52) U.S. Cl.
CPC ..... *H04R 25/453* (2013.01); *H04R 25/405* (2013.01); *H04R 25/505* (2013.01); *H04R 25/402* (2013.01); *H04R 2201/003* (2013.01); *H04R 2225/025* (2013.01); *H04R 2460/09* (2013.01)

(58) Field of Classification Search
CPC ..... H04R 25/453; H04R 25/405; H04R 2225/025; H04R 25/505; H04R 2201/003; G10L 21/0272; G10L 21/0364; G10L 15/20; G10L 19/26; G10L 2021/02161; B81C 1/0023; B81C 1/00269; B81C 1/00309; B81C 1/00333; B81C 2203/0109; B81C 1/00015; B81C 1/00158; B81C 1/00182; B81C 1/00246; B81C 1/00873; B81C 2203/0118
USPC ..... 381/170–175, 318
See application file for complete search history.

(56) References Cited

U.S. PATENT DOCUMENTS 3,183,312 A 5/1965 Solomon et al.
5,031,219 A 7/1991 Ward et al.
5,259,032 A 11/1993 Perkins et al.
(Continued)

OTHER PUBLICATIONS

International Search Report for PCT/US2016/065676 dated Apr. 17, 2017.

*Primary Examiner* — Curtis A Kuntz
*Assistant Examiner* — Julie X Dang
(74) *Attorney, Agent, or Firm* — Law Office of Alan W. Cannon

(57) ABSTRACT

Apparatus, systems and methods for reducing feedback in a hearing aid that includes a transducer configured to detect sound, a sound processor configured to process signals from the transducer, a receiver configured to receive signals outputted from the sound processor, and an acoustic feedback reduction system. The acoustic feedback reduction system is configured to provide signals to the sound processor to produce a null targeting signal steerable toward a source of feedback.

16 Claims, 9 Drawing Sheets

(56) References Cited

U.S. PATENT DOCUMENTS

| | | | |
|---|---|---|---|
| 5,425,104 | A | 6/1995 | Shennib |
| 5,535,282 | A | 7/1996 | Luca |
| 5,572,594 | A | 11/1996 | Devoe |
| 5,606,621 | A | 2/1997 | Reiter et al. |
| 5,645,530 | A | 8/1997 | Sauer et al. |
| 5,682,020 | A | 10/1997 | Oliveira |
| 5,691,515 | A | 11/1997 | Landis |
| 5,881,159 | A | 3/1999 | Aceti et al. |
| 5,920,636 | A | 7/1999 | Oliveira |
| 5,979,589 | A | 11/1999 | Aceti |
| 6,009,183 | A | 12/1999 | Taenzer et al. |
| 6,033,417 | A | 3/2000 | Tseng |
| 6,048,305 | A | 4/2000 | Bauman et al. |
| 6,072,884 | A | 6/2000 | Kates |
| 6,097,823 | A | 8/2000 | Kuo |
| 6,129,174 | A | 10/2000 | Brown et al. |
| 6,137,889 | A | 10/2000 | Shennib et al. |
| 6,256,396 | B1 | 7/2001 | Cushman |
| 6,473,513 | B1 | 10/2002 | Shennib et al. |
| 6,879,695 | B2 | 4/2005 | Maltan et al. |
| 6,940,989 | B1 | 9/2005 | Shennib et al. |
| 7,016,512 | B1 | 3/2006 | Feeley et al. |
| 7,027,608 | B2 | 4/2006 | Fretz et al. |
| 7,076,076 | B2 | 7/2006 | Bauman |
| 7,149,149 | B2 | 12/2006 | Sullivan |
| 7,313,245 | B1 | 12/2007 | Shennib |
| 7,362,875 | B2 | 4/2008 | Saxton et al. |
| 7,421,086 | B2 | 9/2008 | Bauman et al. |
| 7,424,123 | B2 | 9/2008 | Shennib et al. |
| 7,480,387 | B2 | 1/2009 | Meyer et al. |
| 7,627,131 | B2 | 12/2009 | Nielsen et al. |
| 8,477,978 | B2 | 7/2013 | Caldarola |
| 8,553,901 | B2 | 10/2013 | Hersbach |
| 8,934,587 | B2 | 1/2015 | Weber |
| 2002/0027996 | A1 | 3/2002 | Leedom et al. |
| 2002/0085728 | A1 | 7/2002 | Shennib et al. |
| 2003/0005872 | A1 | 1/2003 | DePoy, II |
| 2004/0052391 | A1 | 3/2004 | Bren et al. |
| 2004/0258263 | A1 | 12/2004 | Saxton et al. |
| 2005/0096678 | A1 | 5/2005 | Olson |
| 2005/0238192 | A1 | 10/2005 | Ford et al. |
| 2005/0244026 | A1 | 11/2005 | Nielsen et al. |
| 2006/0067551 | A1 | 3/2006 | Cartwright et al. |
| 2006/0085018 | A1 | 4/2006 | Clevenger |
| 2007/0009106 | A1 | 1/2007 | Tilson et al. |
| 2007/0013052 | A1* | 1/2007 | Zhe ..... B81C 1/0023 257/704 |
| 2007/0100197 | A1 | 5/2007 | Perkins et al. |
| 2007/0236183 | A1 | 10/2007 | Darilek |
| 2008/0137892 | A1 | 6/2008 | Shennib et al. |
| 2008/0253596 | A1 | 10/2008 | Klinkby et al. |
| 2009/0041279 | A1 | 2/2009 | Davis |
| 2009/0052709 | A1 | 2/2009 | Smith |
| 2009/0052710 | A1 | 2/2009 | Smith |
| 2009/0074220 | A1 | 3/2009 | Shennib et al. |
| 2010/0142744 | A1* | 6/2010 | Rombach ..... H04R 19/00 381/355 |
| 2010/0310084 | A1 | 12/2010 | Hersbach |
| 2012/0232333 | A1 | 9/2012 | Miller, III |
| 2012/0296355 | A1 | 11/2012 | Burres |
| 2014/0003640 | A1 | 1/2014 | Puria et al. |
| 2014/0044294 | A1* | 2/2014 | Burns ..... H04R 25/00 381/328 |
| 2014/0052163 | A1 | 2/2014 | Lai |
| 2014/0172333 | A1 | 6/2014 | Gopalakrishnan et al. |
| 2014/0219488 | A1 | 8/2014 | Michel et al. |
| 2014/0294214 | A1 | 10/2014 | Zhao et al. |
| 2015/0063612 | A1* | 3/2015 | Petersen ..... H04R 25/50 381/313 |
| 2015/0289064 | A1 | 10/2015 | Jensen et al. |
| 2016/0345107 | A1 | 11/2016 | Van Dijk et al. |
| 2016/0372104 | A1* | 12/2016 | Nystrom ..... G10K 11/17857 |

* cited by examiner

APPARATUS, SYSTEM AND METHOD FOR REDUCING ACOUSTIC FEEDBACK INTERFERENCE SIGNALS

CROSS-REFERENCE

This application claims the benefit of U.S. Provisional Application No. 62/246,583, filed on Dec. 8, 2015, which application is hereby incorporated herein, in its entirety, by reference thereto, and to which we claim priority under 35 U.S.C. Section 119.

This application also hereby incorporates the following U.S. Patent Applications and their corresponding patents herein, in their entireties, by reference thereto: U.S. patent application Ser. No. 15/195,100, filed Jun. 28, 2016; U.S. application Ser. No. 14/032,310, filed Sep. 20, 2013; U.S. application Ser. No. 13/865,717, filed Apr. 18, 2013, now U.S. Pat. No. 8,577,067; U.S. application Ser. No. 12/841,120, filed Jul. 21, 2010, now U.S. Pat. No. 8,457,337; U.S. Provisional Application No. 61/228,571, filed Jul. 27, 2009; U.S. Provisional Application No. 61/228,588, filed Jul. 26, 2009; and U.S. application Ser. No. 15/373,379, filed on even date herewith and titled "Adjustable Securing Mechanism"

FIELD OF THE INVENTION

The present invention relates to apparatus, systems and methods for reducing acoustic feedback interference signals associated with open in-the-ear (ITE) hearing aids.

BACKGROUND OF THE INVENTION

As is well known in the art, acoustic feedback occurs when some of the amplified sound leaks from the ear canal and is picked up by the ITE hearing aid microphone and then re-amplified. This starts the cycle of leakage and re-amplification (the "feedback loop") that results in the squeal and/or whistle we know as "acoustic feedback."

A traditional solution for reducing acoustic feedback has been to increase the acoustic seal in the ear canal, usually by fabricating tighter, longer, but often more uncomfortable ear molds. For some hearing-impaired people, particularly those with moderate or moderate-to-severe hearing losses, this may take care of the problem. However, there is a limit to the amount of sound isolation that any ear mold can provide; even with the tightest mold; given enough amplification, sound is going to leak from the ear canal and will start the feedback cycle.

A contemporary solution for reducing acoustic feedback associated with open ITE hearing aids is to employ digital signal processing to determine whether a portion of the amplified signal contains elements that have the acoustic characteristics of acoustic feedback. If an acoustic signal does comprise characteristics of acoustic feedback, the feedback circuit first determines the frequency, amplitude, and phase of the feedback component and then generates signals of opposite phase that will cancel (or markedly reduce) the feedback component.

However, since acoustic feedback is often a complex signal (like a tone with a series of harmonics), the cancellation process requires a complex solution, since more than one frequency is involved. This has to be done very quickly and has to be done adaptively. Thus, a disadvantage to this technique is that digital processing methods often eliminate desirable acoustic signals along with the acoustic feedback signal resulting in transmitted audio signal distortion.

There is a continuing need for enhanced systems and methods for reducing acoustic feedback interference signals associated with non-occluding, i.e. open ITE, hearing aids.

SUMMARY OF THE INVENTION

In one aspect of the present invention, a hearing aid is provided that includes a transducer configured to detect sound; a sound processor configured to process signals from the transducer; a receiver configured to receive signals outputted from the sound processor; and an acoustic feedback reduction system configured to provide signals to the sound processor to produce a null targeting signal steerable toward a source of an acoustic feedback signal.

In at least one embodiment, the hearing aid comprises an open in-the-ear (ITE) hearing aid.

In at least one embodiment, the acoustic feedback reduction system comprises a plurality of null-steering microphones positioned and configured to detect a plurality of acoustic input signals and transmit a plurality of signals based thereon to the sound processor, wherein the sound processor is configured to generate a null targeting signal, using the plurality of signals transmitted by the null-steering microphones as inputs.

In at least one embodiment, the plurality of null-steering microphones comprises a plurality of micro electrical-mechanical systems (MEMS) microphones.

In at least one embodiment, the acoustic feedback reduction system comprises an array of null-steering microphones that are positioned between the receiver and the transducer in paths of an acoustic feedback signal on a second plane that intersects a first plane or axis defined by the receiver and the transducer.

In at least one embodiment, the array of null-steering microphones comprises an array of micro electrical-mechanical systems (MEMS) microphones.

In at least one embodiment, the transducer comprises an external microphone.

In at least one embodiment, the hearing aid further includes a finite impulse response (FIR) filter configured to modulate a relative gain and a relative phase of an acoustic calibration signal.

In at least one embodiment, the hearing aid further includes an auto calibration system configured to generate a calibration signal, and detect and measure acoustic feedback emanating from the receiver in response to receiving the calibration signal.

In at least one embodiment, the hearing aid further includes: a casing that houses at least the receiver and the sound processor; and at least one outwardly projecting member extending from the casing and configured to secure the hearing aid in an ear canal.

In at least one embodiment, the hearing aid includes a plurality of outwardly projecting members, wherein the hearing aid comprises an open in-the-ear (ITE) hearing aid.

In at least one embodiment, the hearing aid includes a plurality of outwardly projecting members, wherein at least one of the outwardly projecting members comprises a bristle member comprising a bristle core and at least one bristle vane extending from the bristle core.

In at least one embodiment, the hearing aid includes a plurality of outwardly projecting members, wherein the outwardly projecting members overlap one another to an extent that no straight line-of-sight air pathway exists in a direction coincident with or parallel to a longitudinal axis of the hearing aid.

In at least one embodiment, the acoustic feedback reduction system comprises a plurality of null-steering microphones positioned on the casing at locations intermediate the receiver and the transducer.

In at least one embodiment, the acoustic feedback reduction system comprises a plurality of null-steering microphones positioned in the casing at locations intermediate the receiver and the transducer.

In at least one embodiment, the null-steering microphones comprise MEMS microphones.

In at least one embodiment, the acoustic feedback reduction system is configured to detect a plurality of acoustic input signals and transmit a plurality of the signals based thereon to the sound processor, wherein the sound processor is configured to produce the null targeting signal, using the plurality of signals transmitted by the null-steering microphones as inputs.

In another aspect of the present invention, an integrated, null-steering microphone system is provided that includes: a housing; an opening forming a cavity in the housing; and sensing means closing off one end of the opening; wherein the cavity comprises a volume configured to detect sound frequency down to about 1 KHz.

In at least one embodiment, the sensing means comprises a diaphragm.

In at least one embodiment, the null-steering microphone system comprises a MEMS microphone system.

In at least one embodiment, the sensing means is disposed on a circuit board and the circuit board is mounted on an internal surface of the housing.

In at least one embodiment, the housing comprises a housing of a hearing aid.

In at least one embodiment, the hearing aid comprises an open in-the-ear (ITE) hearing aid.

In another aspect of the present invention, a method of auto calibrating a sound system includes: providing a sound system having a receiver, a transducer, and a plurality of null-steering microphones intermediate the receiver and the transducer; generating a calibration signal and sending the calibration signal to the receiver; determining frequency of an acoustic feedback signal produced by the receiver upon receiving the calibration signal, for each of the plurality of null-steering microphones and the transducer; generating a null targeting signal based on results of the determining; and transmitting the null targeting signal toward the receiver.

In at least one embodiment, transmitting the null targeting signal reduces the acoustic feedback signal amplitude.

In at least one embodiment, the generating and sending a calibration signal includes creating a test signal at each of multiple acoustic feedback frequencies by generating a plurality of signals across a range of frequencies and wherein the determining frequency comprises determining a relative amplitude and a relative phase of each signal received by the null-steering microphones and the transducer to determine the frequency of an acoustic feedback signal. The calibration covers a range of frequencies which exceeds the range at which feedback can occur. The frequency step size is small enough that interpolation between frequency steps produces insignificant error (<1 dB) and so dependents on the flatness of the microphone and receiver.

In at least one embodiment, the sound system comprises a hearing aid and the transducer comprises an external microphone.

In another aspect of the present invention, a method of reducing feedback in a hearing aid is provided that includes: providing the hearing aid comprising a transducer configured to detect sound; a sound processor configured to process signals from the transducer; a receiver configured to receive signals outputted from the sound processor; and an acoustic feedback reduction system comprising at least one null-steering microphone, the feedback reduction system being configured to provide signals to the sound processor; producing a null targeting signal based upon feedback signals received by the at least one null-steering microphone and the transducer; and transmitting the null targeting signal toward the receiver.

In at least one embodiment, the at least one null-steering microphone comprises a plurality of the null-steering microphones.

In at least one embodiment, the hearing aid comprises an open in-the-ear (ITE) hearing aid.

These and other advantages and features of the invention will become apparent to those persons skilled in the art upon reading the details of the invention as more fully described below.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred apparatus, systems, structures and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a," "an" and "the" include plural referents unless the content clearly dictates otherwise. Thus, for example, reference to "a signal" includes two or more such signals and the like.

The following disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

Definitions

The term "stable gain", as used herein, refers to an absolute gain that a hearing instrument or other amplification system can provide without feedback. In the case of hearing instruments, "stable gain" is impacted by factors such as mechanical, electrical, transducer and signal processing design.

"Added stable gain", as used herein, refers to a stable gain difference between feedback reduction on and off. Thus the "added stable gain" provided by a feedback reduction subsystem is the difference between the stable gain of the system when the feedback reduction system is on, and the stable gain of the system when the feedback reduction system is off. Added stable gain is a difference of total stable gain (or maximum stable gain) between the stable gain of the system when the feedback reduction system is on, and the stable gain of the system when the feedback reduction system is off.

Figure 7:
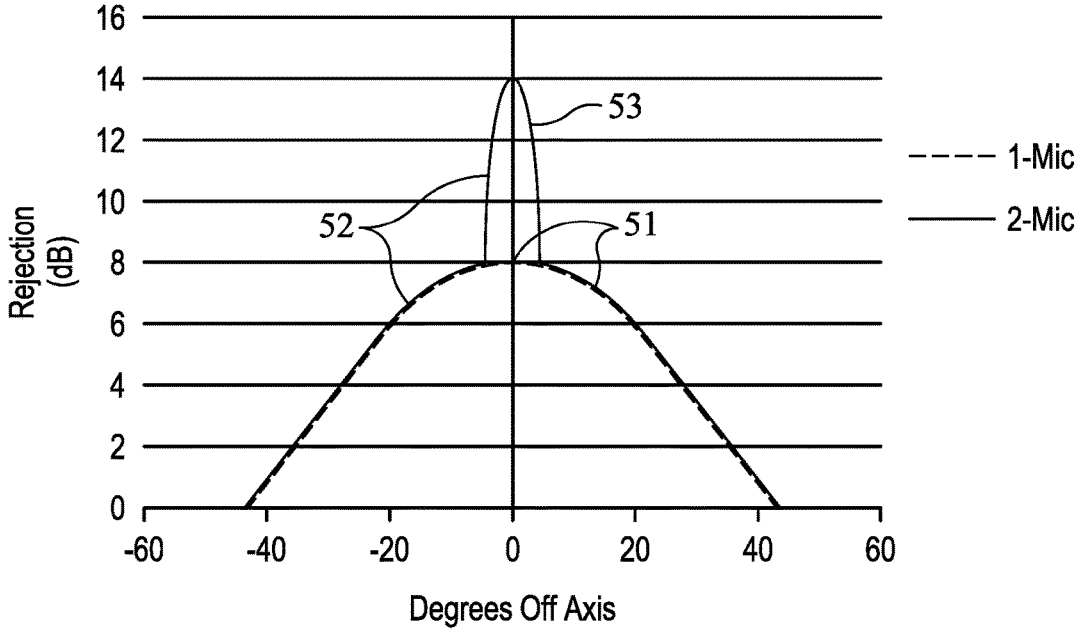
FIG. 7 is a graphical illustration of null targeting signal geometries of null targeting signals generated by two open ITE hearing aids, in accordance with an embodiment of the present invention.

The term "depth", when used herein for characterizing a signal, refers to the maximum amplitude that the signal attains over half a period. Thus, for example, the depth of the 1-Mic signal in FIG. 7 is 8 dB and the depth of the 2-Mic signal in FIG. 7 is 14 dB. "Depth" is defined as the sensitivity from a particular direction relative to the average sensitivity from all directions.

The "width" of a signal characterizes the signal in the second dimension, whereas the depth characterizes the signal in a first dimension. For example, the widths of both the 1-Mic and 2-Mic signals in FIG. 7 extend from about −45 degrees off axis to about +45 degrees off axis.

It is understood that although the apparatus, systems and methods for reducing acoustic feedback interference signals of the invention are described herein in connection with open in-ear (or ITE) hearing aids, the invention is in no way limited to such use. The apparatus, systems and methods of the invention can also be employed with other audio signal transmitting devices, such as public address (PA) systems, speaker phones and conferencing systems.

The present invention is directed to apparatus, systems and methods for reducing acoustic feedback interference signals in open ear hearing devices; particularly, open ITE hearing aids. As discussed in detail herein, in a preferred embodiment, the system comprises a plurality of null-steering microphones that are positioned and configured to detect a plurality of acoustic input signals and transmit a plurality of digital signals based thereon to processing means, wherein the processing means generates a null targeting signal, which digitally reduces the acoustic feedback signal amplitude.

Generally, the sound processing means incorporates one or more signal processors performing a set of specific signal processing algorithms. With modern integration technologies, the one or more signal processors required can be integrated into a single integrated circuit or multi-chip module for minimization of the physical dimensions of the assemblies.

One advantage provided by open ITE hearing aids is the ability to mount microphones on the external casing of the open ITE hearing aid without the microphones being occluded by the surface of the ear canal. The open area between the casing of the hearing aid device and the ear canal is also the path that the acoustic feedback signals take to reach the external microphone of the hearing aid. By positioning at least one microphone in the direct path of the acoustic feedback signal, the acoustic feedback reduction system can precisely detect and measure the acoustic feedback signal.

The acoustic feedback reduction system of the invention in at least one embodiment comprises an array of micro electrical-mechanical systems (MEMS) microphones that are positioned between the receiver of an audio transmitting device, e.g. open ITE hearing aid device, and the external microphone, i.e. in the path of the acoustic feedback signal on a plane that intersects the plane or axis defined by the audio transmitting device external microphone and receiver. By mounting the MEMS microphones as noted, the array of MEMS microphones can be used as null-steering microphones.

In at least one embodiment, the MEMS microphones comprise conventional MEMS microphones having sensing means, e.g., a diaphragm, and an amplifier disposed in an encasement structure. The diameter of a MEMS diaphragm may be within a range from about 0.1 mm to about 10 mm, although the largest and smallest values in this range are not commercially available. At the small end, the sensitivity drops (as the square of the diameter) at the large end too much silicon is required, making the part expensive (less parts per wafer). More preferably, the diameter of a MEMS diaphragm in in a range from about 0.2 mm to about 8 mm or 0.3 mm to about 5 mm or 0.4 mm to about 3 mm, more preferably about 0.5 mm-1 mm.

The encasement structure typically comprises a cavity, e.g., housing cavity, with an aperture. The cavity size is directly related to and, hence, based on the lowest frequency that the sensing means is configured to detect.

A conventional MEMS encasement structure typically comprises a size of approximately 5 mm×3 mm×2 mm, since the cavity and the aperture are designed to support telephony frequencies, e.g., approximately 100 Hz.

In view of the size constraints of a conventional audio transmitting device, such as an open ITE hearing aid, the MEMS sensing means, i.e. diaphragm, is thus disposed in a relatively voluminous encasement structure.

Since the apparatus and systems comprise an array of MEMS microphones, it is desirable to reduce the physical volume required to house each MEMS microphone.

Thus, in at least one embodiment, of the present invention, custom integrated MEMS microphone systems are employed, which substantially reduce the physical volume required to house each MEMS microphone.

Acoustic feedback frequencies observed in personal audio transmitting devices, e.g., an open ITE hearing aid, are typically at frequencies above 1 kHz. Indeed, acoustic feedback frequencies are seldom, if ever, observed at lower frequencies, e.g., at frequencies below about 1 kHz where the physical size of the hearing aid is too small to support sustained feedback oscillations.

As is well known in the art, acoustic feedback is an air propagation property, where the frequency of the acoustic feedback signal is dependent upon the distance of the MEMS microphone from the receiver. As a result, it is virtually impossible to observe long wavelength acoustic feedback, such as acoustic feedback wavelengths on the order of several centimeters or more.

Since a typical acoustic feedback loop has 180° of phase and acoustic feedback frequencies observed in conventional open ITE hearing aid devices are often approximately 2 kHz or more, it is typically unnecessary to cancel any acoustic feedback comprising a frequency lower than approximately 1 kHz.

Based on the above, in at least one embodiment of the present invention, the array of MEMS microphones comprises an array of custom integrated MEMS microphone systems that require minimal space requirements in an audio transmitting device.

As discussed in detail below, in a preferred embodiment of the invention, the integrated MEMS microphone systems are incorporated into the housing of an audio transmitting device, eliminating the need to provide individual encasement structures for each of the MEMS microphones.

Figure 3:
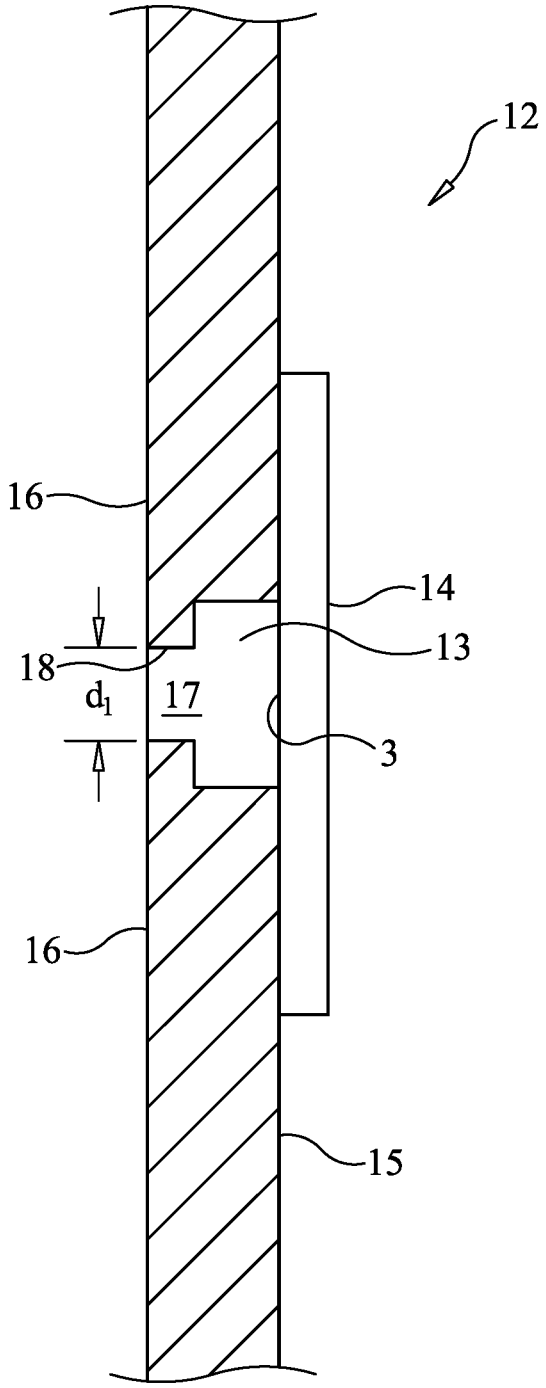
FIG. 3 is a side plan sectional view of an integrated MEMS microphone system, in accordance with an embodiment of the present invention.

Referring now to FIG. 3, there is shown an integrated MEMS microphone system 12 according to an embodiment of the present invention. As illustrated in FIG. 3, the system 12 comprises MEMS sensing means 3 disposed on a circuit board 14, where the circuit board 14 is mounted on the internal surface 15 of the device housing 16. In a preferred embodiment, the sensing means 3 comprises a diaphragm. The diaphragm can be made from a wide range of materials that satisfy a requirement being that the physical mass of the diaphragm not be so large as to impede the sound. Examples of materials that can be used include, but are not limited to: aluminum (foil) and/or metalized plastic.

As further illustrated in FIG. 3, the MEMS sensing means 3 is disposed in a cavity 13 of the device housing 16. Portions of the circuit board 14 and housing 16 form an encasement structure 17. The encasement structure 17 includes an aperture 18 having a diameter dl.

In some embodiments, the aperture 18 preferably comprises a diameter dl in the range of approximately 0.1-1 mm.

In some embodiments, the cavity 13 preferably comprises a volume in the range of 0.01-10 $mm^3$.

As indicated above, a seminal advantage of the incorporation of the integrated MEMS microphones into the cavity 13 of device housing 16 is the substantially reduced space requirement for each integrated MEMS microphone and, hence, an array thereof. Indeed, in some embodiments, the integrated MEMS microphones are at least one tenth (1/10th) the size of a conventional MEMS microphone.

Although an array of smaller MEMS microphones is not as effective with regards to low frequency acoustic feedback cancellation, e.g. frequencies below 1 kHz, the array is found to be at least as effective, and in some configurations, more effective, than an array of conventional MEMS microphones with regard to high frequency acoustic feedback cancellation, e.g. frequencies above 1 kHz.

According to at least one embodiment of the present invention, the acoustic feedback reduction system can also comprise an array of analog microphones that are positioned between the receiver and the external microphone of an audio transmitting device.

According to at least one embodiment of the present invention, the array can comprise as many MEMS microphones that the processing means, i.e. system controller, can accommodate. In at least one preferred embodiment, the system controller comprises a semiconductor digital signal processor (DSP) which can accommodate from two (2) to four (4) MEMS microphones. In some embodiments, the system controller comprises a plurality of DSPs, such as multiple semiconductor DSPs in direct communication with each other.

In at least one preferred embodiment, the array thus comprises three (3) MEMS microphones in addition to at least one external microphone. According to at least one embodiment of the present invention, the MEMS microphones can be spaced at various intervals relative to each other. In at least one embodiment, the MEMS microphones are spaced at 120° intervals relative to each other approximately halfway between the external microphone and the receiver in the area between the audio transmitting device and the ear canal.

Basic physics behind null-steering microphones involves the combination of acoustic signals received by the MEMS microphones in a manner that the acoustic signals add in anti-phase with one another from a signal originating at the location of the null, i.e. combining the signals from at least one MEMS microphone (or analog or other type of microphone) in the MEMS microphone array (or other array of microphones) and the external microphone to cancel the feedback signal emanating from the receiver of an audio transmitting device. By controlling the relative amplitude and phase of the acoustic signal received by the MEMSs microphones (or other null-steering microphones) relative to the feedback signal received by the external microphone, the width and depth of the null targeting signal can be modulated.

In at least one embodiment of the present invention, controlling the relative amplitude and relative phase of the acoustic signal received by the null-steering microphones relative to the feedback signal received by the external microphone can be achieved by modulating the positioning of the audio transmitting device (e.g., hearing aid or other audio transmitting device).

By positioning the null-steering microphones between the receiver and external microphone of an audio transmitting device, the MEMS microphones comprise a different gain and/or phase for a signal originating from the acoustic feedback signal compared to the external microphone. The positioning of the null-steering microphones of the audio transmitting device acoustic feedback reduction system can thus be used for "steering" the null (or null targeting signal) toward the source of the acoustic feedback signal, which reduces the acoustic feedback signal amplitude. Preferably, the null targeting signal is deep enough to reduce the excess gain of the acoustic signal received by the null-steering microphones to less than the acoustic feedback limit prescribed by the physical design of the device. The acoustic feedback limit is defined by the gain and the physical time delay of the device in the patient's ear. The acoustic feedback limit is defined at an in situ gain of unity and an in situ phase shift of 180 degrees.

The acoustic feedback signal that emanates from the receiver of an audio transmitting device comprises characteristics that vary as a function of the anatomy and/or structure of a subject's ear canal, i.e. everybody's acoustic feedback signals are different. However, the acoustic feedback signals that emanate from the receiver of an audio transmitting device are relatively constant and only fluctuate in response to the changes in the anatomy of the ear canal. Indeed, acoustic feedback signals can comprise any frequency, but generally comprise a frequency in the range of approximately 750 Hz-6.5 kHz. More typically, acoustic feedback is found in the range of about 2 kHz to 4.5 kHz, where the acoustic feedback chain has positive gain because a hearing instrument adds higher gain in those frequencies and ear canal resonance frequencies are in this range.

According to one aspect of the present invention, the acoustic feedback reduction system comprises an auto-calibration routine configured to detect and measure the acoustic feedback emanating from the receiver of an audio transmitting device, such as a hearing aid. In some embodiments, an auto-calibration routine comprises a plurality of events carried out to detect and measure acoustic feedback signals emanating from the device receiver employing the acoustic feedback reduction system.

Figure 1:
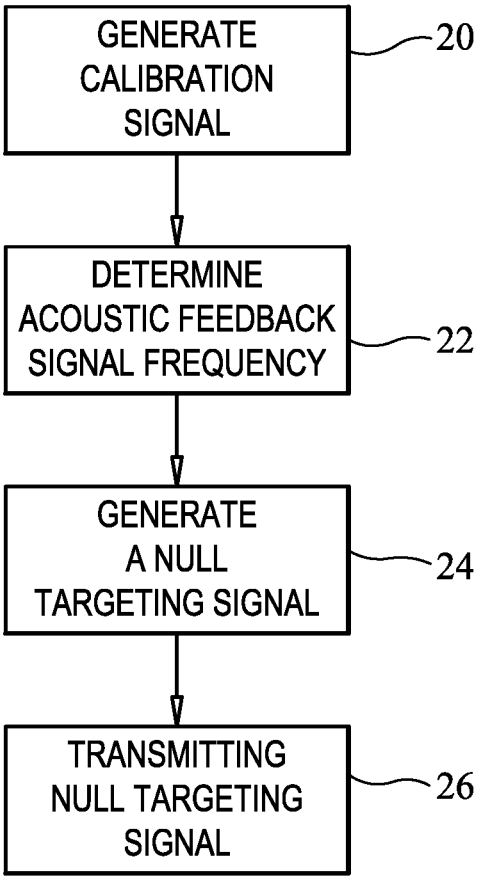
FIG. 1 is a schematic illustration of a method for reducing acoustic feedback signals, in accordance with an embodiment of the present invention.

Referring now to FIG. 1, in a preferred embodiment, the auto-calibration routine comprises a plurality of events that are carried out to detect and measure at least one acoustic feedback signal emanating from the receiver of an audio transmitting device when the device is positioned within the ear canal of a subject, and generates a null targeting signal in response to the detected acoustic feedback signal, which digitally reduces the acoustic feedback signal amplitude.

According to the embodiment of the invention shown in FIG. 1, the auto-calibration routine involves the generation of a calibration signal at event 20. The generation of a calibration signal can be performed by creating a test signal at each acoustic feedback frequency by generating a plurality of signals across a range of frequencies and determining the relative amplitude and the relative phase of the signal received by the null-steering microphones and of the signal received by the external microphone to determine acoustic feedback signal frequency at event 22.

For example, a stepped frequency scan can be performed between 1 kHz and 6 kHz. Typically no more than 100 equally spaced frequency points will be required as the components have a reasonably flat frequency response. This typically takes no more than 2 seconds to complete in practice.

The relative amplitude and the relative phase of the signal received by the null-steering microphones and the external microphone or other transducer providing a similar function to the external microphone provides adequate data to the processing means, such that the processing means can combine the signal received by the null-steering microphone(s) and the signal received by the external microphone in anti-phase (opposite phase).

As discussed in detail below, the routine may further include generating a null targeting signal at event 24 and thereafter transmitting the null targeting signal at event 26 toward the source of the acoustic feedback signal, i.e. receiver, which, as indicated above, reduces the acoustic feedback signal amplitude.

As indicated above, acoustic feedback signals can often be detected at frequencies in the range from about 2 kHz-4.5 kHz. The range of he calibration signals is deliberately larger than the range of feedback signals. For example, the range of calibration signals can be from about 1 kHz to about 6 kHz, as noted above. In some embodiments, the acoustic feedback reduction system thus generates a plurality of acoustic calibration signals at arbitrary frequencies in the range of approximately 1 k Hz-6.0 kHz to detect the acoustic feedback signals.

In some embodiments, the acoustic feedback reduction system generates a plurality of acoustic calibration signals at increasing increments across frequencies in the range of approximately 1 k Hz-6.0 kHz to detect the acoustic feedback signal. The increments can be in the range of 10 to 200, more preferably 25 to 175, 35 to 150, 50 to 125 or 75 to 100. In at least one embodiment, 100 increments were used.

In one preferred embodiment of the invention, the acoustic feedback reduction system generates a plurality of acoustic calibration signals at increasing increments across frequencies in the range of approximately 1-6 kHz to detect the acoustic feedback signal.

In some embodiments, the acoustic feedback reduction system generates a plurality of acoustic calibration signals at decreasing increments across frequencies in the range of approximately 6.0 kHz to 1.0 kHz or 2.0 kHz-750 Hz to detect the acoustic feedback signal.

In at least one preferred embodiment of the invention, the acoustic feedback reduction system generates a plurality of acoustic calibration signals at either increasing or decreasing increments across frequencies in the range of approximately 1.0-6.0 kHz to detect the acoustic feedback signal.

According to an aspect of the invention, a much narrower range of frequencies can be employed since acoustic feedback signals comprise a characteristic frequency that is a function of the roundtrip time of the acoustic signals traveling from the receiver of an audio transmitting device to the external microphone.

By way of example, if there is a 180° phase shift with equal weighted amplitude in the acoustic signal transmitted by the device receiver and the acoustic signal received by the external microphone, it is anticipated that an acoustic feedback signal comprising a frequency of approximately 1.5 kHz results.

According to an aspect of the invention, the acoustic feedback reduction system employs the auto-calibration routine to generate a wave form specific, e.g. a sine wave, acoustic calibration signal by playing a tone at approximately 1.5 kHz, i.e. the anticipated acoustic feedback signal frequency.

According to an aspect of the invention, the acoustic calibration signal that is received by a first null-steering microphone of the array comprises an amplitude A1 and a phase $\varphi$, where $\varphi$1 is the phase delay. If the phase is equal to zero ($\varphi$=0), then the phase delay $\varphi$1 will be a positive number, which results in a smaller amplitude A1 due to acoustic signal loss.

In at least one embodiment, the external microphone of the audio transmitting device will also receive the acoustic calibration signal, but the acoustic signal received by the external microphone will comprise a substantially reduced amplitude A2 when compared to A1 (A2<<A1), and an increased phase delay φ2 when compared to φ1 (φ1<φ2). The difference in the amplitude and the phase delay of the acoustic signals received by the null-steering microphone and the external microphone are used to provide two digital input signals "M1" (null-steering microphone) and "M2" (external microphone) that are subjected to further processing.

According to an aspect of the present invention, the auto-calibration routine processes the M1 and M2 signals, i.e. combines the M1 and M2 signals where the resultant field signal "M" frequency is zero (0), i.e. null (denoted event 24 in FIG. 1).

In at least one preferred embodiment, the frequency of signal M2 is maintained at the same frequency and the frequency of signal M1 is multiplied by the frequency gain, wherein the frequency of M2 is equal to M1, i.e. the M1 signal and the M2 signal comprise the same frequency since M1 is multiplied by the frequency gain. The M1 signal is then phase shifted by "n−n°", whereby M1 is in anti-phase with M2 at the same frequency, which "cancels" both M1 and M2 to provide a null targeting signal, i.e.

$$M=(A_2/A_1)*M_1(\varphi_2-\varphi_1)+M2 \quad \text{Eq.1}$$

According to an aspect of the invention, the resultant field signal "M" is determined via Eq.1 as shown above for an acoustic feedback reduction system comprising one null-steering microphone and one external microphone.

According to another aspect of the present invention, Eq. 1 can be adapted and configured to provide the resultant field signal "M" for any number of null-steering microphones and external microphones employed in the acoustic feedback reduction system.

A seminal advantage of the signal processing step is that the acoustic feedback reduction system is not dependent on precise input variables and only requires the relative amplitude and relative phase of the acoustic signal received by each null-steering microphone and the external microphone.

As shown in Eq. 2 below, the relative phase is defined as the difference in phase delay "$\varphi_2-\varphi_1$", which is equal to the zero crossing difference between $M_1$ and $M_2$ "t" over a period "τ" (reciprocal of a frequency $f_n$) multiplied by 360°, i.e.

$$\tau=1/(f_n) \quad \text{Eq. 2}$$

where:

$\varphi_2-\varphi_1$ (relative phase)=(t/τ)*(360°)(relative frequency)

In at least one preferred embodiment, the processing means generates sets of coefficients that are the relative gain and the relative phase of the acoustic signal for each individual microphone (null and external).

According to an aspect of the invention, the combination of a plurality of nulls (or null targeting signals) results in a single deep broad null. Acoustic input signals received by the null-steering microphones employed in the acoustic feedback reduction system rely on precise phase cancellation and require a null with suitable depth to eliminate acoustic feedback signals. Therefore, a deep broad null generated by combining the plurality of nulls will provide enhanced acoustic feedback signal cancellation compared to a single null generated via one null-steering microphone.

In another preferred embodiment of the invention, a plurality of nulls (or null targeting signals) is generated via a plurality of null-steering microphones, preferably, but not limited to MEMS microphones, wherein each null-steering microphone corresponds to a single null generated by the processing means, i.e. an array of "n" microphones results in "n−1" nulls.

As indicated above, in one preferred embodiment of the invention, the acoustic feedback reduction system comprises an array of three (3) MEMS microphones. However, according to the invention, the MEMS microphone array can comprise more (or fewer, e.g., two (2)) than three (3) microphones. Likewise, the array may comprise other types of microphones, including, but not limited to analog microphones, electric condensers (EC), etc., or combinations of any of these.

A seminal advantage of employing three (3) MEMS microphones is that the acoustic signals received by each MEMS microphone are combined as digital input signals to provide a single cumulative null, i.e. null targeting signal, comprising the breadth and depth suitable for eliminating acoustic feedback signals. In some aspects of the invention, as the number of nulls (or null targeting signals) that contribute to the cumulative null targeting signal was increased, this progressively provided a wider and/or deeper resultant null. However, the depth of the resultant null is not necessarily proportional to the number of null target signals used to generate it, since there may be interferences between various null signals.

Another seminal advantage of employing three (3) MEMS microphones (or other multiple number "n") is that the acoustic feedback reduction system can experience complete loss of function of up to two (2) (or "n−1") MEMS microphones and still provide a null targeting signal. By way of example, if cerumen completely occludes two (2) MEMS microphones in a three (3) MEMS microphone array, the acoustic signals received by the remaining MEMS microphone will still provide a null targeting signal.

Other factors can also influence whether a null targeting signal is produced by a null-steering microphone. For example, FIG. 2E schematically illustrates a hearing aid 10 in which only two null-steering microphones (2A, 2B) are employed, in order to simplify this portion of the disclosure. The receiver 40 is located in the distal end portion of the hearing aid. A transducer (e.g., an external microphone) 4 is located on a proximal end of the housing of the hearing aid device, or at a location proximal to this. The null-steering microphones 2A, 2B are located in the device housing 16 and exposed via an open air pathway 1P to the ear canal 1. The null-steering microphones 2A, 2B are positioned between the receiver 40 and the transducer 4 in paths of an acoustic feedback signal on a plane 21 that intersects a plane or axis 23 defined by receiver 40 and the transducer 4.

In the embodiment shown in FIG. 2E, the distance of each null-steering microphone 2A,2B from the receiver 40 is the same, although this is not required by the present invention. Considering the null-steering microphones 2A, 2B in FIG. 2E to be at location or distance A from location C where the feedback signals are emitted from the receiver, and the location or distance of the transducer 4 as B, the a combined null-steering signal S for the embodiment in FIG. 2E is given by:

$$S=\left(\frac{MA-F1B1}{A-B1}\right)*\left(\frac{MA-F2B2}{A-B2}\right) \quad \text{Eq. 3}$$

Wherein:

$$\left(\frac{MA - F1B1}{A - B1}\right)$$

is the null signal provided by null-steering microphone 2A to the sound processor 50;

$$\left(\frac{MA - F2B2}{A - B2}\right)$$

is the null signal provided by null-steering microphone 2A to the sound processor 50 F1 is the signal from null-steering microphone 2A;

F2 is the signal from null-steering microphone 2B;

M is the signal from the external microphone;

A is the gain applied to the external microphone 4;

B1 is the complex (in amplitude and phase) gain which is applied to null steering microphone 2A which is determined during the calibration process; and B2 is the complex (in amplitude and phase) gain which is applied to null steering microphone 2B which is determined during the calibration process.

After the null targeting signal S is generated, the null targeting signal S is transmitted toward the source of the acoustic feedback signal, i.e. receiver 40, which, as indicated above, reduces the acoustic feedback signal amplitude.

One of the benefits provided by a feedback reduction system employing a plurality of null-steering microphones is that even if one (or more, depending upon the total number of null-steering microphones employed) becomes disabled or nonfunctioning, the system can still provide feedback reduction by the remaining null-steering microphone(s) that is(are) still performing.

Figure 2A:
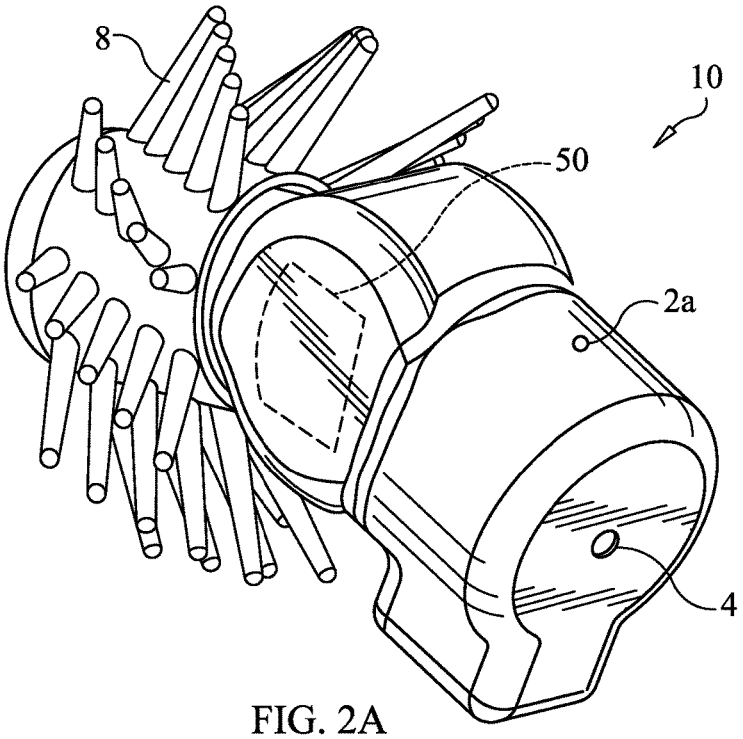
FIG. 2A is a perspective view of an open ITE hearing aid employing an acoustic feedback signal reduction system, in accordance with an embodiment of the present invention.
Figure 2B:
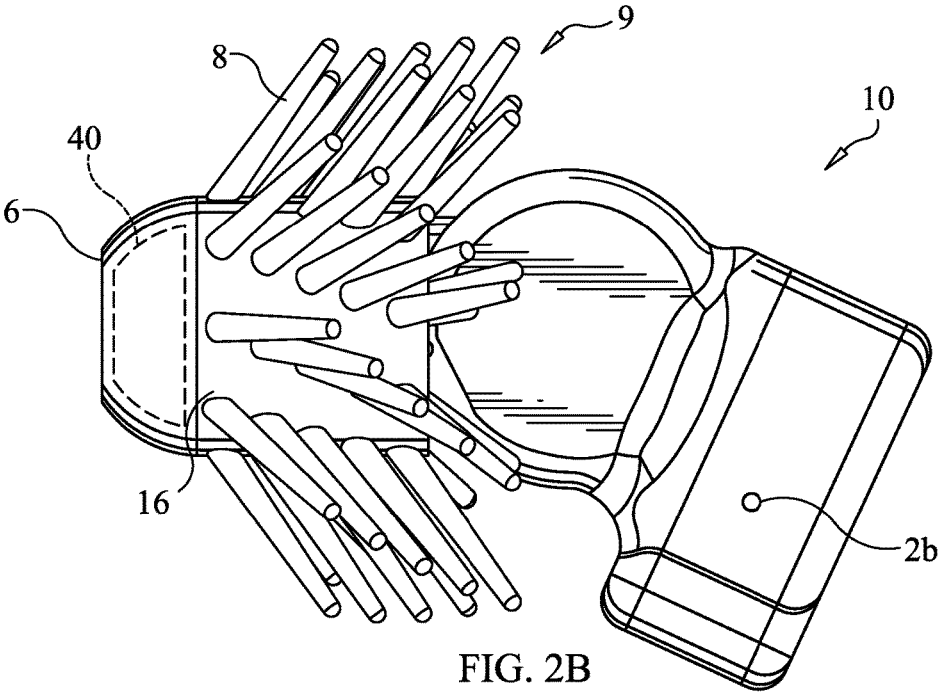
FIG. 2B is a left side plan view of the open ITE hearing aid shown in FIG. 2A.
Figure 2C:
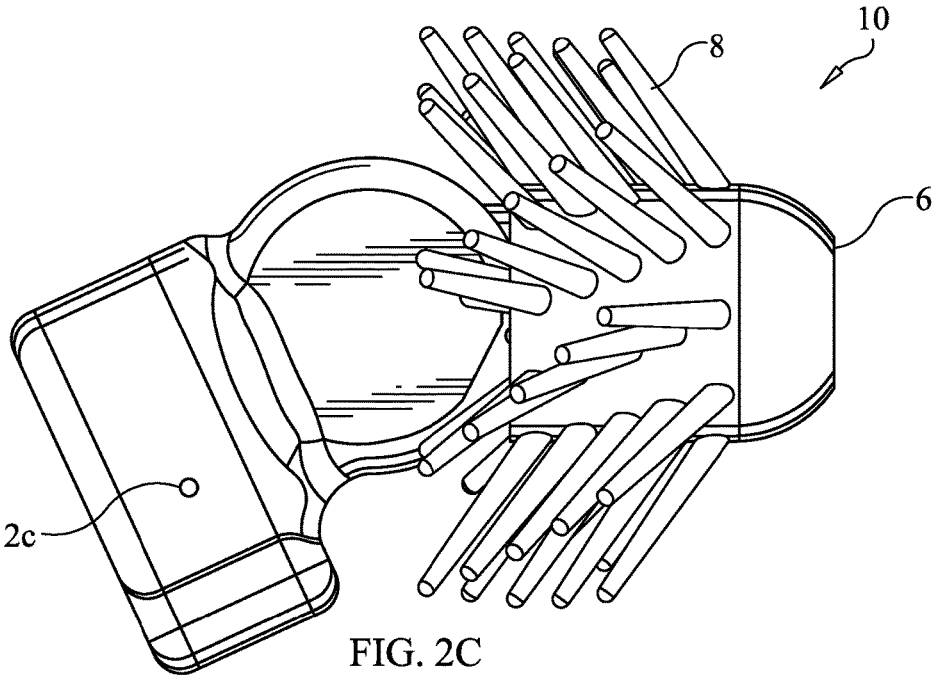
FIG. 2C is a right side plan view of the open ITE hearing aid shown in FIG. 2A.
Figure 2D:
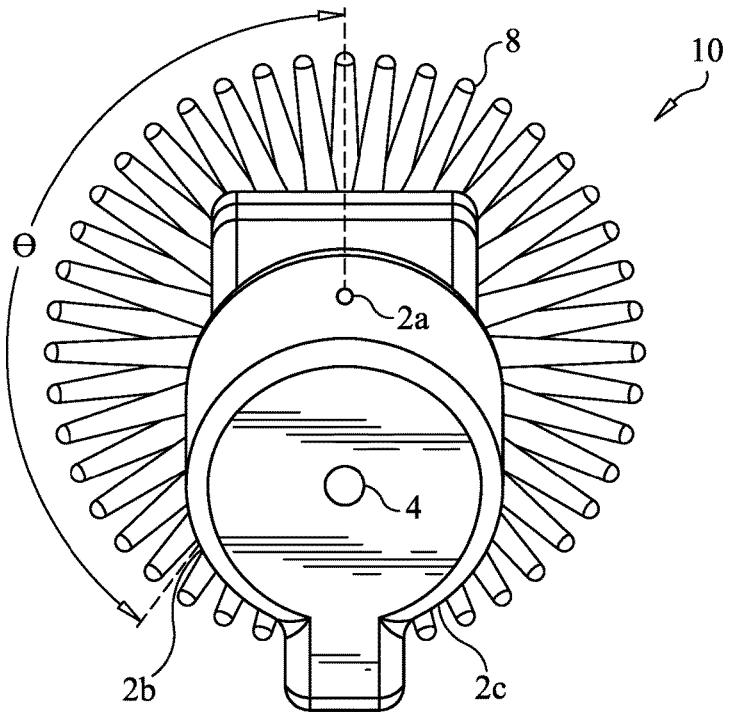
FIG. 2D is a rear plan view of the open ITE hearing aid shown in FIG. 2A.
Figure 2E:
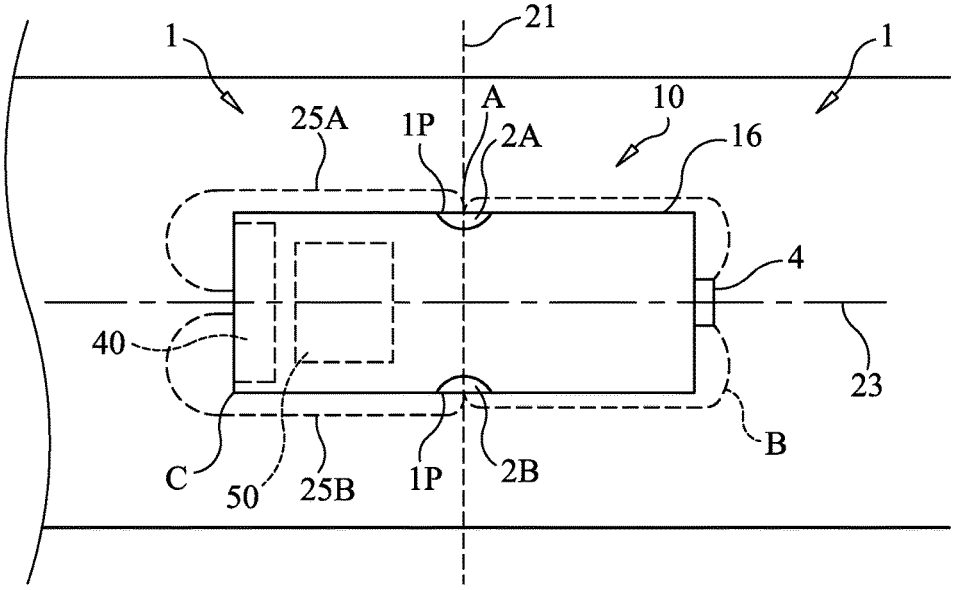
FIG. 2E is a schematic illustration of a an open ITE hearing aid that includes a system for reducing acoustic feedback signals, in accordance with an embodiment of the present invention.
Figure 2F:
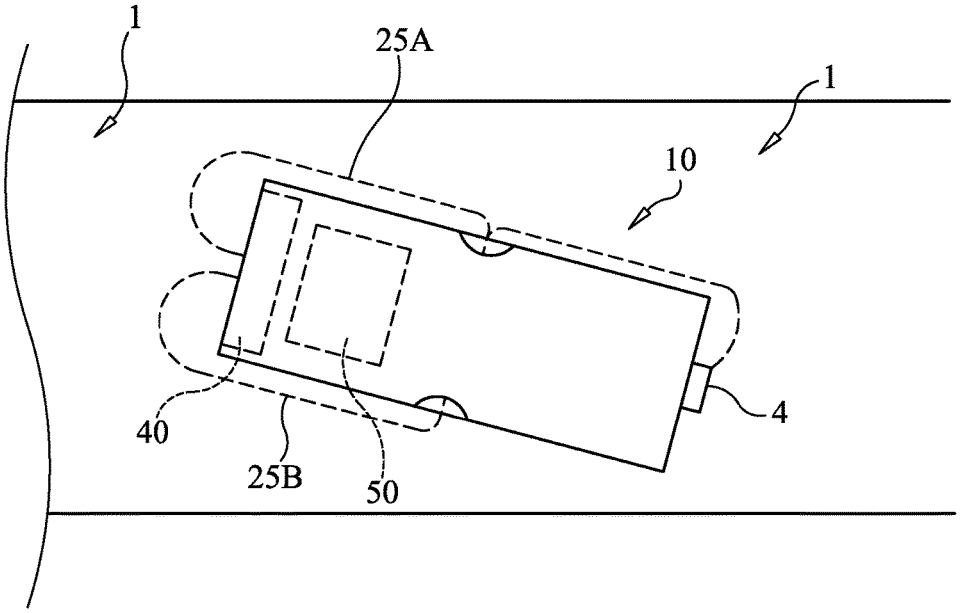
FIG. 2F schematically illustrates the embodiment of FIG. 2E, but wherein the device has shifted within the ear canal.

FIG. 2F schematically illustrates the embodiment of FIG. 2E, but wherein the device 10 has shifted within the ear canal. In this instance, the feedback signal 25B is effectively cut off from reception at the transducer 4 and only the feedback signal 25A reaches the transducer with an amplitude that is practically processable for feedback reduction. In this case, the null signal would not be provided as pertains to microphone 2B and the resultant null-steering signal would be from the signal from microphone 2A as follows:

$$S = \left(\frac{MA - F1B}{A - B}\right) \quad \text{Eq. 4}$$

According to an aspect of the present invention, the acoustic feedback reduction system can be combined with or replaced by a finite impulse response (FIR) filter to modulate the relative gain and relative phase of each acoustic calibration signal to generate cancellation over a predetermined range of frequencies. Since amplitude and phase difference are frequency-dependent, these alternative aspects may be more efficient for generating null signal over wide ranges of frequencies. The FIR filter can be applied in conjunction with feedback cancellation algorithms, but the FIR algorithm, by itself, is quite limited because when too much additional gain is added, the algorithm produces intolerable artifacts in normal speech. Even at small amounts (5-7 dB) of additional gain speech starts to sound 'electronic' like a robot.

The acoustic feedback reduction system can also be combined with a feedback reduction algorithm including, without limitation, continuously adapting algorithms, such as a variation of "least mean square" (LMS) algorithms, "closed-loop processing with no probe noise" (CNN) algorithm and/or intermittently adapting algorithms, such as an "open-loop with noise when oscillation detected" (ONO) algorithm and an "open-loop with noise when quiet detected" (ONQ) algorithm.

Referring now to FIGS. 2A-2D, there is shown an acoustic feedback reduction system employed on an audio transmitting device; in this instance, an open ITE hearing aid 10, according to an embodiment of the present invention. As illustrated in FIGS. 2A-2D, the hearing aid 10 comprises an external microphone 4, an internal receiver 40 (shown schematically in phantom lines, see FIG. 2B), which is preferably disposed in the distal end portion proximate the distal end 6 of the hearing aid 10, and three (3) MEMS microphones 2*a*, 2*b*, 2*c*. Preferably, the MEMS microphones 2*a*, 2*b*, 2*c* are disposed proximate the internal receiver 40. By locating the MEMS microphones near the internal receiver 40, this makes the amplitude difference between the MEMS microphones 2*a*, 2*b* and 2*c* and the external microphone 4 larger. For example, the MEMS microphones 2*a*, 2*b*, 2*c* (etc.) can be located around the battery near the internal receiver. An assembly 9 comprising a plurality of outwardly projecting members 8 is included in device 10, wherein the members 8 extend from at least a portion of the housing 16 of the device 10 (from a distal end portion 16D of the housing 16 in the embodiment shown in FIGS. 2A-2D, although locations may vary). "Outwardly projecting member", as used in connection with a securing mechanism of the invention, means and includes any projection extending from a base member, including, without limitation, fins, bristles, protrusions, ridges, blades, grooves, bubbles, balloons, hooks, looped structure and/or tubes.

The assembly or securing mechanism 9 preferably includes at least one, more preferably, a plurality of outwardly projecting members, which, according to the invention, can comprise, without limitation, fins, bristles, protrusions, ridges, blades, grooves, balloons, bubbles, hooks, looped structures and/or tubes.

According to at least one embodiment of the invention, the outwardly projecting members 8 can comprise separate members 8, i.e. engaged to a base component 16 or integral members 8 integral with and projecting from a base component 16.

The securing mechanisms and/or projecting members 8 thereof can comprise various conventional compliant and flexible materials, including, without limitation, silicone, rubber, latex, polyurethane, polyamide, polyimide, nylon, paper, cotton, polyester, polyurethane, hydrogel, plastic, feather, leather, wood, and NITINOL®. In some embodiments of the invention, the securing mechanisms and/or projecting members comprise a polymeric material.

As set forth in U.S. application Ser. No. 14/032,310, which is incorporated by reference herein in its entirety, the projecting members 8 can have the same length or may have varying lengths. For example, bristles may have lengths greater than, less than, equal to, or falling between any of the following: 0.1 mm, 0.2 mm, 0.3 mm, 0.4 mm, 0.5 mm, 0.7 mm, 1 mm, 1.5 mm, 2 mm, 2.5 mm, 3 mm, 3.5 mm, 4 mm, 4.5 mm, 5 mm, 5.5 mm, 6 mm, 7 mm, 8 mm, 9 mm, 1 cm, 1.1 cm, 1.2 cm, 1.3 cm, 1.5 cm, 1.7 cm, 2 cm, 2.5 cm, or 3 cm.

The projecting members 8 can also have any cross-sectional shape and size, including varying shapes and thicknesses (or diameters). For example, the projecting members may be flat, rounded, elliptical, square, triangular and/or hexagonal. The projecting members may have a diameter, length, or width, greater than, less than, or falling between any of the following, 1 μm, 2 μm, 3 μm, 5 μm, 7 μm, 10 μm, 15 μm, 20 μm, 30 μm, 50 μm, 75 μm, 100 μm, 125 μm, 150 μm, 200 μm, 300 μm, 500 μm, 1 mm, 2 mm or 3 mm.

In some embodiments of the invention, the securing mechanisms and/or projecting members 8 comprise a coated, preferably, compliant and flexible material. According to at least one embodiment of the invention, the base material can be coated with various materials and compositions to enhance the lubricity, alter the friction, adjust the hydrophobicity, or increase the stability in the chemical, environmental, and physical conditions of the target space or opening of the projecting members.

The base material can also be coated with or contain various materials to allow for administration of a pharmacological agent or composition to biological tissue.

The coating material can thus comprise, without limitation, active agents or drugs, such as anti-inflammatory coatings, and drug eluting materials.

The coating material can also include non-pharmacological agents.

In at least one embodiment, the securing mechanism 9 of the invention is designed and adapted to self-conform or self-adjust to the shape of the interior surface of an opening (or interior space) of a member (biological or non-biological) when a device 10 of the invention and, thereby, the projecting members 8 are inserted in the opening and in a constrained state. In some embodiments of the invention, each projecting member 8 is adapted to flex and/or deform to conform to the shape and/or size of the interior surface. In some embodiments of the invention, one or more member(s) 8 is adapted to flex and/or deform to conform to the shape and/or size of the interior surface. These and other features of the securing mechanism/assembly 9 may be included in embodiments of the present invention. Other features that may be included are further disclosed in U.S. application Ser. No. 14/250,862, filed Apr. 11, 2014, now U.S. Pat. No. 9,167,362; and U.S. application Ser. No. 14/874,838, filed Oct. 5, 2015, now U.S. Pat. No. 9,344,819, each of which are hereby incorporated herein, in their entireties, by reference thereto.

As further illustrated in FIG. 2D, MEMS microphones 2*a*, 2*b*, 2*c* (and additional MEMS microphones, if employed) are preferably positioned in an array that is disposed on a plane that intersects the plane or axis defined by the hearing aid external microphone and receiver. In a preferred embodiment, the MEMS microphone array comprises a generally circular array. In at least one preferred embodiment, the plane of the array is generally orthogonal to the axis, but in other preferred embodiments, it is non-orthogonal.

The MEMS microphones 2*a*, 2*b*, 2*c* are also preferably positioned at uniform angular intervals of "θ°" relative to each other. In at least one preferred embodiment, the microphones 2*a*, 2*b*, 2*c* are positioned at angles of 120 degrees relative to one another.

According to an aspect of the invention, the MEMS microphones 2*a*, 2*b*, 2*c* (and additional MEMS microphones, if employed) can also be positioned at non-uniform intervals on the casing of open ITE hearing aid 10.

As indicated above, in some embodiments of the invention, the MEMS microphone array comprises more than three (3) MEMS microphones. In some embodiments, six (6) MEMS microphones are thus positioned at uniform angular intervals of 60°. In some embodiments, eight (8) MEMS microphones are positioned at uniform angular intervals of 45°.

According to an aspect of the invention, when the open ITE hearing aid 10 is disposed in an ear canal 1 of a subject, the hearing aid 10 is preferably configured to generate a null targeting signal for any shape and geometry of the ear canal 1. As discussed in detail above, in a preferred embodiment, the acoustic feedback signals comprise characteristics that vary as a function of the shape and geometry of a subject's ear canal 1.

By positioning MEMS microphones 2*a*, 2*b*, 2*c* at uniform angular intervals of 120° relative to each other, a null targeting signal can be generated for any type of acoustic feedback signal. A null targeting signal can also be generated for acoustic feedback signals oriented at any angle relative to plane or axis defined by the external microphone and receiver of the open ITE hearing aid 10.

According to an aspect of the invention, the open ITE hearing aid 10 is also configured to perform an auto-calibration routine when positioned within the ear canal of a subject by generating at least one acoustic calibration signal, which is detected by the microphones 2*a*, 2*b*, 2*c* and the external microphone 4. The processor 50 (represented schematically by phantom lines in FIG. 2A) then determines the relative phase and relative amplitude of the acoustic calibration signal, and subsequently performs the processing described above to generate at least one null targeting signal or null, which is transmitted toward the source of the acoustic feedback signal, which reduces the amplitude of the acoustic feedback signal.

According to an aspect of the invention, when an audio transmitting device, such as hearing aid 10, is positioned in a subject's ear, the auto-calibration routine is configured to generate at least one null targeting signal for any given topography of securing means associated therewith, such as bristle assembly 9 shown in FIGS. 2A-2D.

Figure 4:
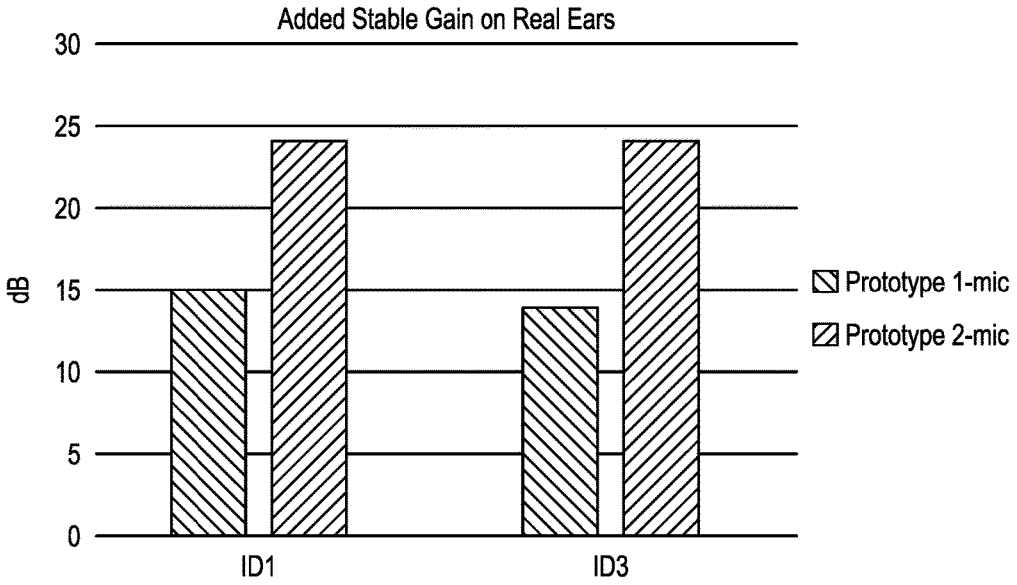
FIG. 4 is a graphical illustration showing the difference in added stable gain between a conventional single microphone system and a two microphone acoustic feedback signal reduction system, in accordance with an embodiment of the present invention.

Referring now to FIG. 4, there are shown bar graphs showing the increase in added stable gain of an open ITE hearing aid employing a single conventional external MEMS microphone (denoted "Prototype 1-mic") and an acoustic feedback reduction system of the invention, comprising one MEMS microphone and one electric condenser (EC) array, i.e. a null steering MEMS microphone and external MEMSEC microphone (denoted "Prototype 2-mic"). Thus, Prototype 1-mic has only an external transducer microphone, while Prototype 2-mic has an external transducer microphone and one MEMS feedback cancellation microphone. The MEMS and EC microphone arrangement of "Prototype 2-mic" was used because the hearing instrument prototype circuit was already designed for this setup. However, it would be preferable to use same type MEMS microphones in an array, rather than the MEMS-EC setup. Still the MEMS-EC setup does exhibit proof of concept.

As illustrated in FIG. 4, the acoustic feedback reduction system provides an increase in added stable gain of approximately 9-10 dB over a conventional single microphone system, i.e. 9-10 dB of additional gain is provided without detectable acoustic feedback. Total stable gain is the maximum gain which can be applied without feedback. Added stable gain is the total stable gain with feedback cancellation turned on minus the total stable gain with feedback cancellation turned off. The Prototype 2-mic acoustic feedback reduction system used for FIG. 4 was a combination of microphone array null signal cancellation and a conventional single microphone feedback reduction system.

According to an aspect of the invention, as the number of null steering MEMS microphones in the MEMS microphone array increases, this provides a progressively greater total stable gain. By way of example, a three (3) MEMS microphone array comprising three (3) null steering MEMS microphones would be expected to provide a greater total stable gain compared to a two (2) MEMS microphone array.

As discussed in detail above, a seminal advantage of employing a plurality of MEMS microphones is that the acoustic signals received by each MEMS microphone are combined as digital input signals to provide a single cumulative null, i.e. null targeting signal, comprising the breadth and depth suitable for eliminating an acoustic feedback signal. The number of nulls (or null targeting signals) that contribute to the cumulative null targeting signal is, in some instances, directly proportional to the depth of the resultant null. Typically however, the number of null target signals progressively provides higher resultant null, but the increase in the higher resultant cumulative null targeting signal it is not necessarily proportional to the increase in the number of null targeting signals that contribute to the cumulative null targeting signal because of interferences between two or more null targeting signals that may occur.

According to the an aspect of the invention, the depth of the resultant cumulative null targeting signal is proportional to the added stable gain observed by an audio transmitting device, such as a hearing aid. In some embodiments, the acoustic feedback reduction system provides an added stable gain in the range of 15-25 dB.

Figure 5:
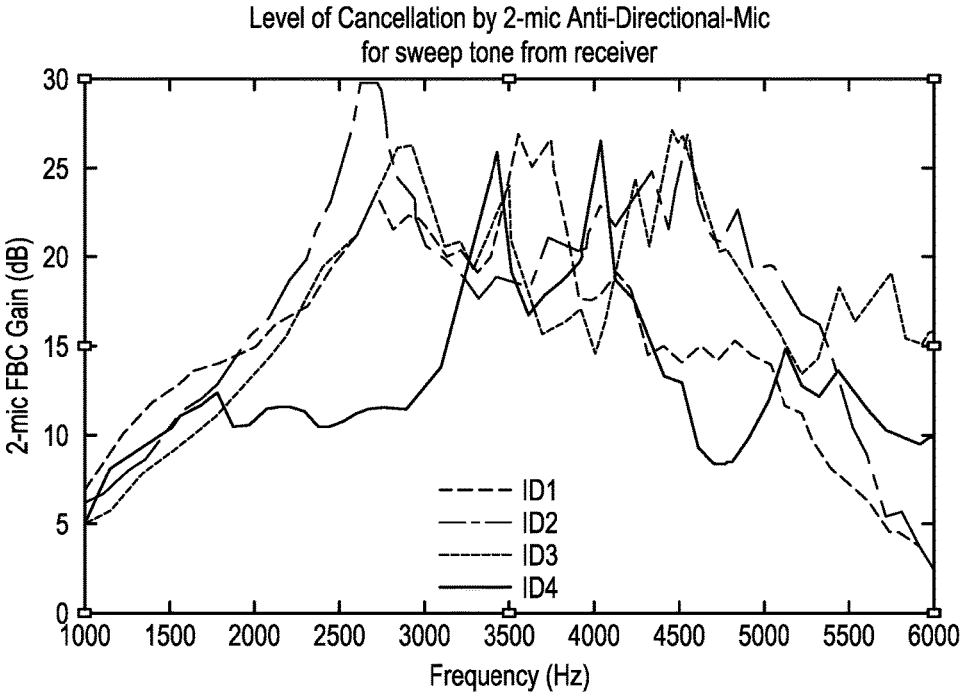
FIG. 5 is a graphical illustration showing the added stable gain of four open ITE hearing aids employing a two microphone acoustic feedback signal reduction system over a predetermined frequency range, in accordance with an embodiment of the present invention.

Referring now to FIG. 5, there is shown a graph representing the added stable gain of four open ear ITE hearing aid devices (denoted "ID1", "ID2", "ID3" and "ID4"), employing the same two (2) microphone array as employed in FIG. 4, over frequencies in the range of 1 kHz to 6 kHz.

As illustrated in FIG. 5, an added stable gain of approximately 15-20 dB is observed at frequencies in the range of approximately 2.5-5.5 kHz across open ear ITE hearing aid devices ID1, ID2, ID3. As further illustrated in FIG. 5, device ID4 exhibits slightly lower added stable gain than others, yet it is approximately 10-20 dB in the range of 2.5-5.5 kHz. The added stable gain shown in FIG. 5 is provided solely by MEMS microphone array null signal cancellation, while the added stable gain of Prototype 2-mic shown in FIG. 4 is from a combination of null signal cancellation and conventional feedback cancellation.

Figure 6A:
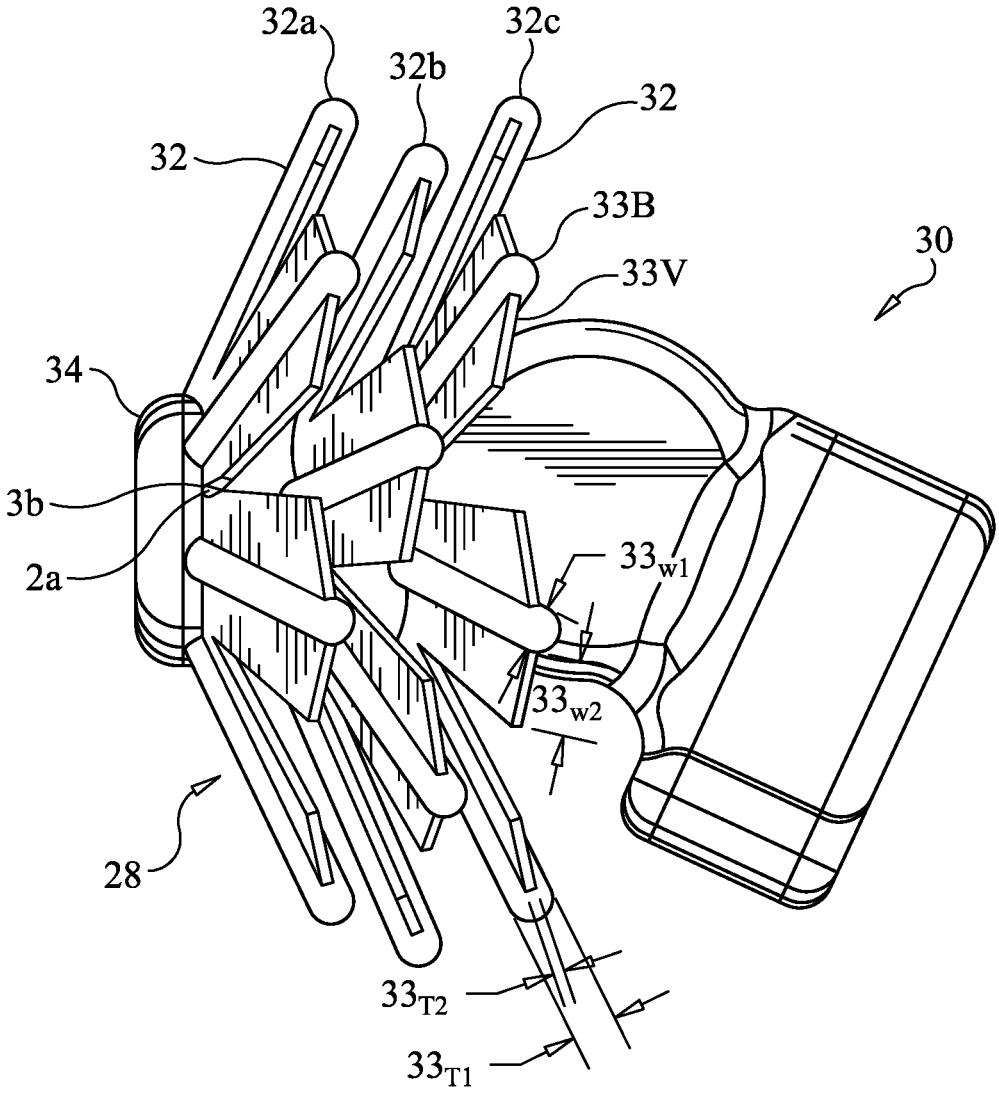
FIG. 6A is a left side plan view of an open ITE hearing aid, in accordance with another embodiment of the present invention.
Figure 6B:
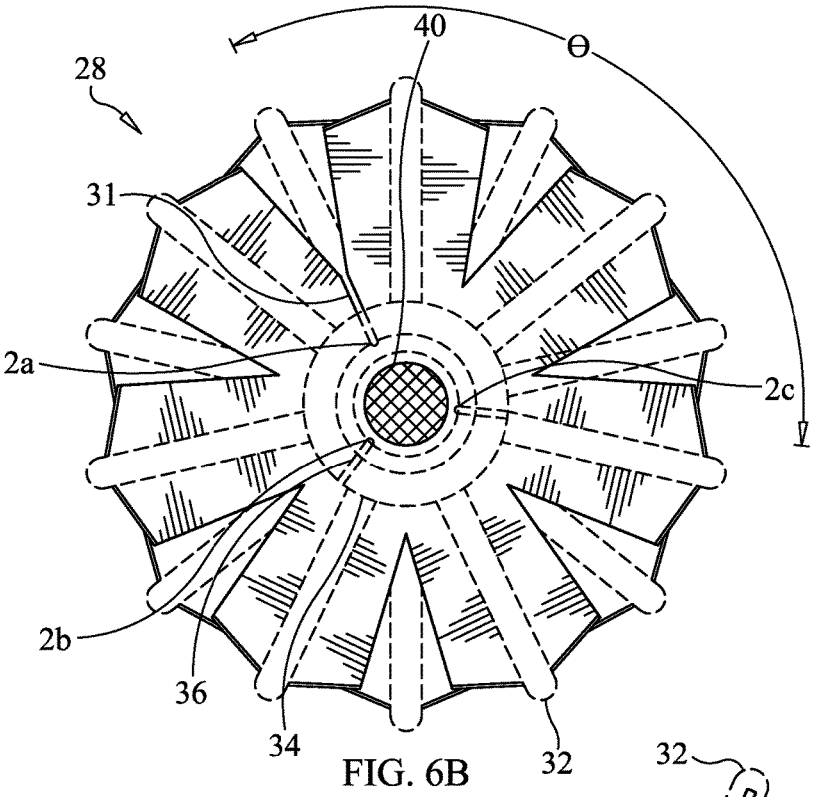
FIG. 6B is a front plan (distal end) view of a bristled assembly of the open ITE hearing aid shown in FIG. 6A.
Figure 6C:
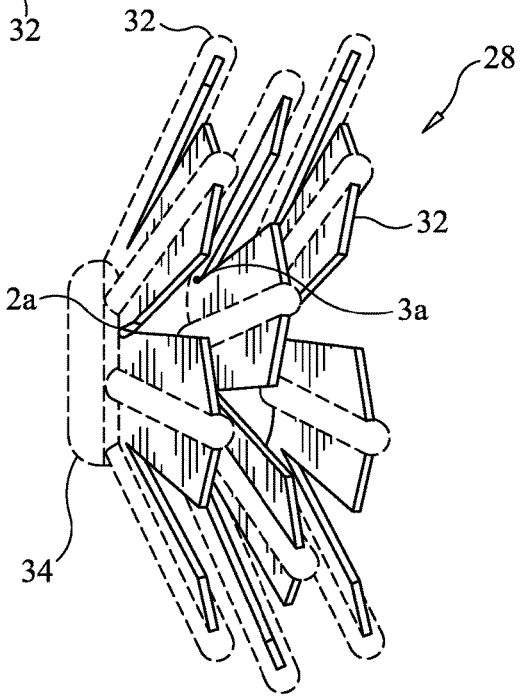
FIG. 6C is a left side plan view of the bristled assembly of the open ITE hearing aid shown in FIG. 6A.

According to an aspect of the invention, the acoustic feedback reduction system can also be employed on an audio transmitting device that is configured to have a higher degree of occlusion when the positioned in an ear canal, i.e., occluding the ear without forming a complete seal, such as the open ITE hearing aid shown in FIG. 6A-6C.

Referring now to FIGS. 6A-6C, the open ITE hearing aid 30 has a bristle assembly 28 that is disposed at a distal end portion 34 of hearing aid 30. In alternative embodiments, bristled assembly 9 may be provided alternatively or in addition to that shown in FIG. 6A by being disposed on one or more of the intermediate section and proximal end portion of the hearing aid 30. The bristle assembly 28 comprises a plurality of bristle members 32 arranged on a first circumferential array of bristle elements 32*a*, a second circumferential array of bristle elements 32*b* and a third circumferential array of bristle elements 32*c*. The bristle members 32 may include sound reducing vanes 33V that are provided on bristle cores 33B as shown in FIGS. 6A-6C. In the embodiment shown in FIGS. 6A-6C, the bristle core 33V is substantially cylindrical (although other cross-sectional shapes may be employed, as noted above) and provided added structural support to the bristle member 32. The vanes 33V in this embodiment have a thickness 33T2 that is less that a thickness 33T1 (e.g., diameter, or other cross-sectional dimension) of the bristle core. The width of the vanes W2 is greater than the width W2 of the bristle core 33B in the embodiment of FIGS. 6A-6C, but need not be in all embodiments. Furthermore, the width 33W2 may vary along the length of the vane 33V. The lengths of the vanes 33V may be equal to, slightly less than, or substantially less than the lengths of the bristle cores 33B. In the embodiment of FIGS. 6A-6C, all bristle elements 32 are provided with two vanes 33V each. It is within the scope of the present invention that there may be one or more vanes 33V on a bristle core 33B to form a bristle element 32 and/or some bristle elements 32 may have no vanes 33V. An advantage provided by the vanes 33V is the reduction of feedback, as these vanes 33V further assist acoustic feedback reduction in open ITE hearing aids for users with more severe hearing loss, relative to the amount of hearing loss experienced by users of open ITE hearing aids that do not employ the vanes 33V.

As illustrated in FIGS. 6A-6C, the bristle assembly 28 preferably includes three (3) openings or perforations 36 disposed at juncture points between selective bristle elements 32. However, in other embodiments, more or fewer opening 36 can be provided. Likewise in other embodiments, more or fewer than three bristled elements 32A, 32B, 32C may be provided in a bristle assembly 28. According to an aspect of the invention, bristle assembly 28 can be perforated using any conventional method, such as laser perforation.

As illustrated in the distal end view of FIG. 6B, the bristled elements 32*a*, 32*b* and 32*c* and the bristle members 32 are arranged in such a way that they overlap one another from element 32*a* to element 32*b* to element 32*c* such that they effectively close off any straight air path from extending longitudinally therethrough (i.e. in a direction parallel to, or coincident with axis 23 in FIG. 2E. This greatly reduces or muffles feedback signals from receiver 40 to microphone 4 as the signals are air propagated, as mentioned above, and must go through a very tortuous pathway to bypass all of the bristle members. The vaned bristle members 32 act as baffles that substantially reduce or mute the feedback signals from reaching the microphone.

In the arrangement of FIGS. 6B-6C, the elements 32*a*-32*c* are arranged such that the vaned members 32 of element 32*a* completely overlie the gaps between the vaned members 32 of element 32 *b*, and the vaned members of element 32*b* completely overly the gaps between the vaned members 32 of element 32*c*. However, the present invention is not limited to this configuration, as other configurations can be provided to perform the same or a similar function.

As further illustrated in FIGS. 6A-6C, the hearing aid 30 further includes null-steering microphones 2*a*, 2*b*, 2*c*, preferably MEMs microphones, which are disposed in the perforations 36 of the bristle assembly 28. In a preferred embodiment, the microphones 2*a*, 2*b*, 2*c* are positioned at uniform angular intervals of "θ" degrees relative to each other. In a preferred embodiment, each angular interval "θ" comprises an interval of 120°.

According to an aspect of the invention, the microphones 2*a*, 2*b*, 2*c* and any additional microphones, if employed, can be positioned at any uniform angular intervals of "θ" degrees at any point along the plane or axis of the casing of open ITE hearing aid 30 defined by the external microphone 4 and receiver 40 of the hearing aid 30.

Thus, in some embodiments, wherein six (6) microphones are employed, the microphones are positioned at uniform angular intervals of 60°. In some embodiments, wherein eight (8) MEMS microphones are employed, the MEMS microphones are positioned at uniform angular intervals of 45°.

According to an aspect of the invention, the MEMS microphones 2*a*, 2*b*, 2*c* and any additional microphones, if employed, can also be positioned at any non-uniform angular intervals of "θ" degrees (e.g., θ1≠θ2≠θ3, etc.).

When hearing aid 30 is positioned in an ear canal, the level of occlusion can, and often will, vary along different regions of the ear canal by virtue of a plurality of factors, such as bone growth and cerumen accumulation. Thus, if MEMS microphone 2*a* is positioned proximate the receiver 40 disposed at the distal end portion 34 of hearing aid 30 and MEMS microphone 2*b* is positioned at a greater distance away from receiver 40 than MEMS microphone 2*a*, MEMS microphone 2*a* and MEMS microphone 2*b* will detect different levels of attenuation. If MEMS microphone 2*c* is positioned at a greater distance from receiver 40 than MEMS microphone 2*b*, then MEMS microphone 2*c* will also detect a different level of attenuation.

It is thus advantageous to average the attenuation of acoustic signals detected by each MEMS microphone; particularly, MEMS microphones 2*a*, 2*b*, 2*c* in this embodiment, in order to generate a null targeting signal that compensates for varying levels of occlusion.

In at least one preferred embodiment, the processing means of the hearing aid 30 is configured to average the attenuation of acoustic signals detected by microphones 2*a*, 2*b*, 2*c*. As indicated above, when hearing aid device 30 is positioned in an ear canal, the attenuation of acoustic signals detected by microphones 2*a*, 2*b*, 2*c* can, and often will, vary by virtue of a plurality of factors. Such factors further include the topography of the ear canal, the topography of hearing aid 30 and the difference in the level of occlusion of an ear canal between the first, second and third circumferential array of bristle elements 32*a*, 32*b*, 32*c*.

As discussed in detail below, the proximity of microphones 2*a*, 2*b*, 2*c* to the receiver 40 disposed at the distal end portion 34 of hearing aid 30 will determine the geometry of a null targeting signal. A null-steering microphone that is positioned proximate the receiver 40 will provide a narrower and deeper null targeting signal than a null targeting signal generated by a null-steering microphone that is positioned a greater distance away from receiver 40. A null-steering microphone that is positioned a greater distance away from the receiver will provide a broader and shallower null targeting signal relative to that provided by a closer placed hull-steering microphone.

According to an aspect of the invention, numerous additional factors can affect the breadth and the depth of a null targeting signal generated by the acoustic signals received by a null-steering microphone. Such factors include the level of attenuation detected by the null-steering microphone, positioning of the null-steering microphone, the topography of the ear canal and the topography of the hearing aid 30.

Referring back to FIGS. 6B and 6C, by way of example, if MEMS microphone 2*a* is disposed proximate the first circumferential array of bristle elements 32*a*, and a MEMS microphone, i.e. MEMS microphone 3*a*, is disposed proximate the second circumferential array of bristle elements 32*b*, MEMS microphone 2*a* will be disposed closer to the receiver 40 than MEMS microphone 3*a*. Since MEMS microphone 3*a* is positioned at a greater distance from receiver 40 than MEMS microphone 2*a*, MEMS microphone 3*a* will, thus, provide a broader, but shallower null targeting signal than the null targeting signal provided by MEMS microphone 2*a*.

As also discussed in detail below, the null targeting signals provided by any set of null-steering microphones, such as MEMS microphones 2*a* and 3*a*, are combined digitally by the processing means 50 of hearing aid 30, which results in a null targeting signal that comprises a distinct null targeting signal geometry.

According to an aspect of the invention, any quantity of null targeting signal geometries can be combined digitally to provide distinct null targeting signal geometry. In at least one preferred embodiment, the null targeting signal geometry is configured to substantially reduce and/or eliminate acoustic feedback signals independent of ear canal and audio transmitting device topography.

Referring now to FIG. 7, there is shown a graphical illustration representing the null targeting signal geometry for two null targeting signals generated by similar open ITE hearing aids, according to an embodiment of the present invention, where the null targeting signal geometry is represented as rejection over degrees off the plane or axis defined by an external microphone and receiver of the open ITE hearing aid. According to an aspect of the invention, the rejection is directly proportional to the added stable gain observed by the open ITE hearing aid.

As illustrated in FIG. 7, curve 51 corresponds to a null targeting signal generated by an open ITE hearing aid system employing one (1) MEMS null steering microphone (denoted "1-Mic"). Curve 52 corresponds to a null targeting signal generated by the same open ITE hearing aid system with an additional null steering MEMS microphone positioned closer to the receiver, i.e. a two (2) null steering MEMS microphone system (denoted "2-mic").

As reflected in the FIG. 7, the null targeting signal generated by the 1-mic system, i.e. reflected by curve 51, comprises breadth in the range of approximately −45° to 45° off axis and a peak rejection, i.e. depth, of approximately 8 dB.

As also reflected in the FIG. 7, as the null targeting signal is steered away from the origin, i.e. 0°, in both the positive and negative direction, the rejection of the null targeting signal decreases until the rejection reaches 0 dB at approximately 45° and −45°, i.e. curve forms a half-sinusoid null targeting signal geometry.

As further reflected in FIG. 7, curve 51 and curve 52 comprise the same rejection of the null targeting signal at breadths in the range of approximately −45° to −5° and 5° to 45° off axis, i.e. curve 51 and curve 52 overlay each other at breadths in the range of approximately −45° to −5° and 5° to 45° off axis. Curve 52 thus comprises the same symmetrical decrease in rejection of the null targeting signal in both the noted positive and negative direction ranges to form the half-sinusoid null targeting signal geometry of curve 51.

However, the additional MEMS microphone positioned proximate the hearing aid receiver, i.e. 2-mic system, generates a peak 53 along curve 52 comprising a breadth in the range of approximately −5° to 5° off axis and a peak rejection of 14 dB. Curve 52 thus reflects a broad null targeting signal that comprises a higher degree of rejection (or depth) at the origin, i.e. 0°, than a null targeting signal generated by a hearing aid system with one MEMS null steering microphone, i.e. 1-mic system.

A seminal advantage of the null targeting signal geometry provided by the two (2) MEMS null steering microphone system is thus that the null targeting signal comprises the breadth suitable for broad range of acoustic feedback signals, while also comprising the rejection or depth necessary for increased stable gain.

As discussed in detail above, any number of MEMS microphones (limited of course by the physical space needed to accommodate the MEMS microphone) can be positioned on the audio transmitting device at any distance from the receiver of the device to provide a null targeting signal geometry having any shape or configuration.

As will readily be appreciated by one having ordinary skill in the art, the present invention provides numerous advantages compared to conventional acoustic feedback signal reduction systems. Among the advantages are the following:

The provision of acoustic feedback signal reduction systems that eliminate the feedback problems that are associated with most hearing aids;

The provision of acoustic feedback signal reduction systems that have the ability to auto-calibrate in situ; and The provision of acoustic feedback signal reduction systems that can accurately detect acoustic feedback signals and generate a useable null targeting signal.

The provision of acoustic feedback signal reduction systems that can generate null targeting signals having a plurality of various shapes and geometries.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, component, device, material, composition of matter, process, process step or steps, to the objective, spirit and scope of the present invention. All such modifications are intended to be within the scope of the claims appended hereto.

That which is claimed is:

1. An integrated, null-steering microphone system comprising:

a housing comprising a wall layer having an external surface and an opposing internal surface;

an opening forming a cavity in said wall layer of said housing, said opening extending through said external and internal surfaces; and a diaphragm of a microphone sensing means closing off one end of said opening along the internal surface, wherein sound can enter the opening though said external surface an input to said microphone sensing means;

wherein said cavity comprises a volume configured to detect sound frequency down to about 1 KHz; and wherein said system is configured to provide signals to a sound processor to produce a null targeting signal toward a source of an acoustic feedback signal.

2. The system of claim 1, wherein said null-steering microphone system comprises a MEMS microphone system.

3. The system of claim 1, wherein said microphone sensing means is disposed on a circuit board and said circuit board is mounted on said internal surface of said housing.

4. The system of claim 1, wherein said housing comprises a housing of a hearing aid.

5. The system of claim 4, wherein the hearing aid comprises an open in-the-ear (ITE) hearing aid.

6. The system of claim 1, wherein the null targeting signal is a steerable null targeting signal;

wherein a plurality of said openings form a plurality of said cavities, and a plurality of said microphone sensing means respectively close off said plurality of openings to form a plurality of null-steering microphones;

wherein an external microphone is provided in or on said housing at a location proximal of said plurality of said openings and a receiver is provided in said housing at a location distal of said plurality of said openings; and wherein said plurality of null-steering microphones are configured to detect a plurality of acoustic input signals and transmit a plurality of signals based thereon to the sound processor to produce the steerable null targeting signal.

7. The system of claim 6, wherein said housing extends circumferentially around an internal space, and wherein said plurality of null-steering microphones are spaced circumferentially around the internal space to form an array.

8. The system of claim 7, wherein said system comprises three null-steering microphones spaced at 120 degree intervals around the internal space.

9. An integrated, null-steering microphone system comprising: a housing of a hearing aid, said housing surrounding an internal space, said housing comprising a wall having an external surface and an internal surface;

a plurality of null-steering microphones disposed at spaced intervals about said housing so as to form an array that circumscribes said internal space and a longitudinal axis of said housing;

wherein each of said null-steering microphones is located at one of a plurality of openings forming cavities in said wall layer of said housing, each said opening extending through said external and internal surfaces, and comprises a diaphragm of a sensing means closing off one end of each said opening respectively, along the internal surface, so that sound can enter the opening though said external surface; and wherein said system is configured to provide signals to a sound processor to produce a null targeting signal toward a source of an acoustic feedback signal.

10. The system of claim 9, wherein the hearing aid comprises an open in-the-ear (ITE) hearing aid.

11. An integrated, null-steering microphone system comprising: a housing, said housing surrounding an internal space, said housing comprising a wall having an external surface and an internal surface;

a plurality of null-steering microphones disposed at spaced intervals about said housing so as to form an array that circumscribes said internal space and a longitudinal axis of said housing;

wherein each of said null-steering microphones comprises a diaphragm of a sensing means located at one of a plurality of openings forming cavities in said housing closing off one end of each said opening respectively, along the internal surface; and wherein said system is configured to provide signals to a sound processor to produce a null targeting signal toward a source of an acoustic feedback signal.

12. The system of claim 11, wherein said null-steering microphones comprise MEMS null-steering microphones.

13. The system of claim 11, wherein each of said null-steering microphones comprises sensing means disposed on a circuit board.

14. The system of claim 13, wherein said circuit board is mounted on said internal surface of said housing; wherein each of said openings extends through said external and internal surfaces; and wherein said null-steering microphone closes off one end of said opening along the internal surface; and wherein sound can enter the opening though said external surface.

15. The system of claim 11, wherein said housing comprises a housing of a hearing aid.

16. The system of claim 15, wherein the hearing aid comprises an open in-the-ear (ITE) hearing aid.

* * * * *